US006641706B1

(12) United States Patent
Lindwall et al.

(10) Patent No.: US 6,641,706 B1
(45) Date of Patent: Nov. 4, 2003

(54) DEVICE FOR PROCESSING A METAL SURFACE

(75) Inventors: Reine Johan Thorbjörn Lindwall, Linghem (SE); Anna Lindwall, Rimforsa (SE); Torbjörn Lindwall, Linghem (SE)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/830,464

(22) PCT Filed: Oct. 22, 1999

(86) PCT No.: PCT/FI99/00878

§ 371 (c)(1),
(2), (4) Date: Jan. 8, 2002

(87) PCT Pub. No.: WO00/27542

PCT Pub. Date: May 18, 2000

(30) Foreign Application Priority Data

Nov. 5, 1998 (FI) ..... 982398

(51) Int. Cl.[7] ..... C25B 9/00; B05C 3/04

(52) U.S. Cl. ..... 204/275.1; 204/206; 118/419; 118/429; 134/122 R; 134/199

(58) Field of Search ..... 205/705; 134/122 R, 134/64 R, 198, 199; 204/194, 206, 207, 232, 242, 275.1; 118/400, 419, 429

(56) References Cited

U.S. PATENT DOCUMENTS

| | | | | |
|---|---|---|---|---|
| 3,926,767 A | * | 12/1975 | Brendlinger et al. | 204/206 |
| 4,270,317 A | * | 6/1981 | Kurie | 451/40 |
| 4,811,748 A | * | 3/1989 | Murao et al. | 134/122 R |
| 5,312,530 A | | 5/1994 | Lindwall | 204/206 |

* cited by examiner

*Primary Examiner*—Edna Wong
*Assistant Examiner*—Brian L Mutschler
(74) *Attorney, Agent, or Firm*—Morgan & Finnegan, LLP

(57) ABSTRACT

The invention relates to a device to be used in processing of a surface of metal object to be processed which surface is essentially continuously in onwards motion. According to the invention a processing agent (1) is to be directed to the surface (5) to be processed by nozzles (6) in at least one position so that at most 70 per cent of the surface (5) to be processed is under processing in one position of directing processing agent (1).

15 Claims, 1 Drawing Sheet

DEVICE FOR PROCESSING A METAL SURFACE

BACKGROUND OF THE INVENTION

1. Field of the Invention

The invention relates to a device for processing a metal surface of a metal object which is in motion during the processing.

2. Description of Related Art

The U.S. Pat. No. 5,312,530 describes a surface processing device for running material. This device is provided with an inner cavity that is fed with a processing agent under pressure. A jet forming slot is used to direct a well laminar jet of the processing agent under an acute angle, 40 to 70 degrees, to the running material. The jet forming slot is rotational symmetric and surrounds the path, along which the material is passed. Further, an;electric electrode is disposed in the cavity, whereby an additional electrode is disposed, in the passage direction of the material, slightly spaced from the jet forming spot, whereby a bipolar electrolyte cell is formed. It is practical, that a plurality of processing units, each having an inner cavity and a jet forming slot are arranged one after the other in the passing direction of the material. The cavity is annular and it opens towards the axial bore, through which the material to be processed runs, through an annular slot. The processing agent emerges through the slot in annular shape of such a small width that the jet acts as a knife. The electrodes enhance the cleaning effect further. If the electrode disposed with the cavity is connected to the minus pole whereas the other electrode surrounding the running material is connected to the plus pole of the rectifier then the surface to be processed becomes anodic under the narrow jet of the processing agent. Thereby, the resistive layer of solved contaminants and metal ions surrounding the running material will be dissolved and permits a higher current to pass through the cell.

When using an annular slot as in the referred U.S. Pat. No. 5,312,530 segments of the jets from the opposed directions weaken each other so that the total effect to agitate the surface of the object is not as strong as the sum effect of the segments of the jets individually could be.

BRIEF SUMMARY OF THE INVENTION

The object of the present invention is to eliminate some of the drawbacks of the prior art and to achieve a new and more viable device for processing a metal surface of a metal object which is in motion during the processing so that the processing agent is fed by jets to the surface of the metal object. The essential novel features of the invention are apparent from the appended claims.

According to the invention the processing agent is directed by jets to the surface of the metal object being in motion through nozzles which are positioned to each other so that part of the surface to be processed is under processing in one position of directing processing agent. In one position of directing processing agent to the surface to be processed there is at least one nozzle through which a jet of the processing agent is directed to the surface so that at most 70 per cent of the surface to be processed is under direct influence of the jets. The jet emerges from a hole of the nozzle having maximum width less than 8 times of the width of the surface. In the device of the invention there are at least two positions of directing processing agent to the surface to be processed within a distance to each other so that essentially the whole surface to be processed is at least once under the jets of the processing agent in that time when the surface of the metal object is going through the device of the invention.

In the device of the invention there is at least one reservoir which is filled with processing agent. The processing agent is a medium for coating, electrolytic cleaning or plating which are most suitable treatments to be processed by means of the device of the invention. The reservoir is provided with an inlet in one wall and with an outlet in another wall opposite to the first wall. The inlet and the outlet are used to direct the metal object to be processed in motion of high speed up to 20 to 40 m/s through the reservoir in case of coating. In plating the typical speeds are from 5 to 40 m/s.

The metal object to be processed is in the device of the invention in the interaction between the processing agent and the metal surface. In order to minimise the so called diffusion layer on the metal surface, the metal object is treated by a strong agitation or mixing of the processing agent in a very close vicinity of the metal surface. A turbulence which will minimise the diffusion layer, is partly caused by the metal object itself which is in motion through the reservoir of the processing agent. In order to increase turbulence in the vicinity of the metal surface, in the reservoir there are installed in at least two positions at least one nozzle in each position to direct jets of the processing agent against the metal surface.

When using the device of the invention the consecutive positions of directing jets are advantageously so operated that the directions of the jets are different. Therefore, the metal surface is processed in each position of directing jets so that advantageously the same part of the metal surface is not processed in two consecutive positions. The consecutive positions of directing jets can also be in separate reservoirs.

The jet from one position can be directed so that the direction of the jet is essentially perpendicular to the metal surface. The direction of the jet can also be such that the jet forms an acute or obtuse angle with the moving direction of the metal surface to be processed. The directions of the jets even in the consecutive positions can be different; one can have direction in acute angle and the other in an obtuse angle. The directions of the jets formed in the same position can be different depending on the surface to be processed.

DESCRIPTION OF THE DRAWINGS

The invention is described in more detail with reference to the appended drawings, wherein.

Figure 1:
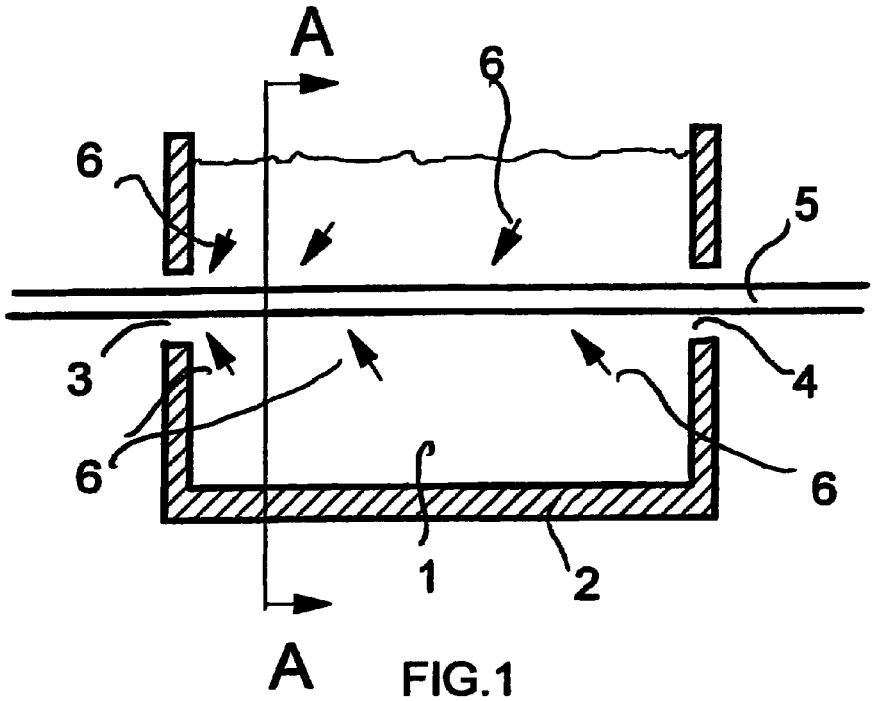
FIG. 1 is a schematic side-view illustration of the preferred embodiment of the invention.
Figure 2:
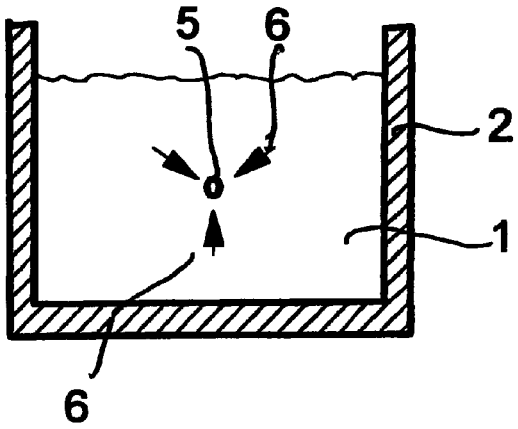
FIG. 2 is a partial and schematic side-view illustration from the direction A—A of the embodiment in FIG. 1.

In accordance with FIGS. 1 and 2 coating medium 1 is in a reservoir 2. The reservoir 2 is provided with an inlet 3 in one wall of the reservoir 2 and with an outlet 4 in the other wall of the reservoir 2 opposite to the first wall of the reservoir. The metal wire 5 is in onwards motion from the inlet 3 to the outlet 4. In vicinity of the metal wire 5 in the reservoir 2 there are installed nozzles 6 for directing jets of the coating medium to the surface of the metal wire. The nozzles 6 direct the jets of the coating medium to the metal wire surface from different directions as shown in arrows. In one position of the nozzles 6 only part of the metal wire surface is a target for jets of the coating medium.

What is claimed is:

1. Device used in processing of a surface of a metal object which surface is essentially continuously in onwards motion, comprising at least one reservoir filled with a processing agent capable of receiving a feed of the metal object, the reservoir provided with nozzles in at least one position, the nozzles installed and positioned within the reservoir with respect to each other so that jets of the processing agent are directed onto the whole surface of the metal object processed by means of the nozzles, there being at least three nozzles that are positioned circumferentially around the longitudinal axis of the metal object, in order that at most 70 percent the surface of the metal object processed is under processing in one position of the directing processing agent, and so that essentially the whole surface to be processed is at least once under the jets of the processing agent when the whole surface of the metal object is going through the device, a hole of each nozzle from which the jet of processing agent emerges having a maximum width less than eight times the width of the surface of the metal object.

2. Device according to the claim 1, wherein at least one nozzle is installed in one position of directing processing agent.

3. Device according to the claim 1 wherein at least two nozzles are installed in the same position of directing processing agent in order to direct the processing agent from different directions to the surface to be processed.

4. Device according to the claims 1 or 2, wherein at least one nozzle is installed in respect of the motion of the surface processed in consecutive positions of directing processing agent in order to direct the processing agent from different directions to the surface processed.

5. Device according to any of the claims 1–3, wherein the nozzle to used for directing processing agent is installed in essentially perpendicular fashion to the surface to be processed.

6. Device according to any of the claims 1–3, wherein the nozzle to used for directing processing agent is installed in an acute angle to the surface to be processed.

7. Device according to any of the claims 1–3, wherein the nozzle used for directing processing agent is installed in an obtuse angle to the surface to be processed.

8. Device according to any of the claims 1–3, wherein the nozzle is a jet nozzle.

9. Device according to any of the claims 1–3, wherein the positions of directing processing agent are in separate reservoirs filled by processing agent.

10. Device according to any of the claims 1–3, wherein the processing agent used is a coating medium.

11. Device according to any of the claims 1–3, wherein the processing agent used is a plating medium.

12. Device according to any of the claims 1–3, wherein the processing agent used is a medium for electrolytic cleaning.

13. The device according to claim 1, wherein the nozzles positioned circumferentially around the metal object are approximately equally spaced relative to each other and to the longitudinal axis of the metal object.

14. The device according to claim 1, wherein each of the nozzles of the device is longitudinally spaced apart along the longitudinal axis of the metal object.

15. The device according to claim 1 wherein there are three nozzles.

* * * * *